United States Patent [19]

Hanyu

[11] Patent Number: 4,693,198

[45] Date of Patent: Sep. 15, 1987

[54] ADJUSTING DEVICE OF SLACK AMOUNT OF LOWER THREAD IN ZIGZAG SEWING MACHINE

[75] Inventor: Susumu Hanyu, Tokyo, Japan

[73] Assignee: Janome Sewing Machine Co. Ltd., Tokyo, Japan

[21] Appl. No.: 777,954

[22] Filed: Sep. 19, 1985

Related U.S. Application Data

[63] Continuation-in-part of Ser. No. 560,422, Dec. 12, 1983, abandoned.

[30] Foreign Application Priority Data

Dec. 27, 1982 [JP] Japan ..... 57-226790

[51] Int. Cl.[4] ..... D05B 3/02; D05B 27/00; D05B 49/00; D05B 57/26

[52] U.S. Cl. ..... 112/443; 112/231; 112/242; 112/255; 112/260; 112/324

[58] Field of Search ..... 112/255, 443, 184, 231, 112/242, 260, 324

[56] References Cited

U.S. PATENT DOCUMENTS

| | | | |
|---|---|---|---|
| 1,105,968 | 8/1914 | Diehl et al. | 112/242 |
| 2,900,940 | 8/1959 | Johnson | 112/184 |
| 3,390,653 | 7/1968 | Ketterer | 112/184 X |
| 3,693,563 | 9/1972 | Ketterer | 112/184 |
| 3,894,499 | 7/1975 | Hamlett | 112/184 X |
| 4,215,639 | 8/1980 | Johnson | 112/242 |
| 4,340,003 | 7/1982 | Hanyu et al. | 112/191 |
| 4,423,693 | 1/1984 | Hanyu et al. | 112/324 |
| 4,437,421 | 3/1984 | Johnson | 112/184 X |
| 4,458,613 | 7/1984 | Eguchi et al. | 112/184 |

*Primary Examiner*—Wm. Carter Reynolds
*Attorney, Agent, or Firm*—Michael J. Striker

[57] ABSTRACT

There is a zigzag sewing machine provided with a horizontal rotary loop taker device which is restrained with respect to the rotation direction, and holds therein a bobbin carrier horizontally attached, and is supplied with a lower threads from the left side to the left basic line marked with an axial line in front of the needle, and provided with a feed dog which is provided nearly to passage of the needle to move vertically and laterally. In such a sewing machine a cam portion is provided for supplying the lower thread to a lower thread contacting portion of the bobbin carrier or a lower thread contacting portion of a part connecting right and left teeth of the feed dog, whereby the amount of supplying the lower thread is adjusted properly with respect to the left basic line and the right basic line during zigzag stitching, and the slack amount of the lower thread is adjusted properly with respect to the left basic line and the right basic line during forming stitches. A cam portion is provided to the lower thread contacting portion of a needle plate for guiding the lower thread to change the passage of the lower thread, whereby the slack amount of the lower thread may be adjusted properly with respect to the left basic line and the right basic line during forming stitches, and the lower thread of the zigzag stitch is made pretty on a rear side of the sewn fabric.

2 Claims, 11 Drawing Figures

PRIOR ART

ADJUSTING DEVICE OF SLACK AMOUNT OF LOWER THREAD IN ZIGZAG SEWING MACHINE

This is a continuation of application Ser. No. 560,422, filed Dec. 12, 1983 now abandoned.

BACKGROUND OF THE INVENTION

The present invention relates to a device for adjusting the amount of slack in a lower thread in a zigzag sewing machine, especially, a zigzag sewing machine which contains a horizontal rotary loop taker to which the lower thread is supplied from a left side of the leftmost needle dropping point thereof. The present device adjusts the lower thread biasing leftward on a rear side of a fabric under zigzag stitching.

The prior art will be discussed with reference to the attached drawings for convenience. The zigzag sewing machine is, as shown in FIG. 2, contains a horizontal rotary loop taker 2 provided with a basic line disposed in front of a needle 1 which moves vertically and laterally. When straight stitching is carried out especially at the needle dropping leftmost point L (called "left basic line"), so-called hitch stitching will often occur. This is why the lower thread 4 from a bobbin 3 is disordered and it comes to the right side of the needle when the former crosses with the latter. For moving such occasions, as shown in FIG. 2, the lower thread 4 is set in such a way that it is pulled through a lower thread supply 2*a* and biased to the left side with regard to the left basic line L.

Thus, hitch stitching is avoided if the straight stitching is operated at the left basic line L. In this case, assume that the needle dropping rightmost point (called "right basic line") is R, the largest amplitude of the needle 1 is W, the length between the lower thread supply 2*a* and the left basic line L is ($l_1$), and the length between the lower thread supply 2*a* and the right basic line R is ($l_2$). Since the lower thread supply 2*a* is near the left side with regard to the left basic line L, and when the zigzag stitching is undertaken at the largest width W, then the slack amount of the lower thread when stitching on the left basic line L is approximately $l_2+W$, while the slack amount of the lower thread when stitching on the right basic line R can be approximately $l_1+W$. As is seen, since the amount of the former is more than the amount of the latter therefore, the lower thread 4 at the left basic line L is, as shown in FIG. 4, easily pulled up by an upper thread 5. With respect to the zigzag stitching of the sewn fabric, since a knotting $6_L$ at the left side is near the left basic line L, and a knotting $6_R$ at the right side is near the center of a stitch, the width $W_2$ between the right knotting $6_R$ at the right basic line R is therefore larger than the width $W_1$ between the left knotting $6_L$ and the left basic line L. Subsequently, when the tension of the upper thread 5 is slightly high, then the stitches of the lower thread 4 on the left basic line L easily appear to spoil the zigzag stitches 6.

SUMMARY OF THE INVENTION

The present invention has been devised to remove the above mentioned shortcomings of the prior art.

A sewing machine is provided with a horizontal rotary loop taker which is restrained with respect to the rotating direction holding therein a bobbin carrier which is horizontally attached and supplied with a lower thread from the left side to the left basic line marked with an axial line in front of the needle, and a feed dog which is provided near to the passage of the needle so as to move vertically and horizontally. In such a sewing machine, a cam portion is provided for supplying the lower thread to a lower thread contact of the bobbin carrier or a lower thread contact of a portion connecting right and left teeth of the feed dog, so that the amount of the lower thread supplied is adjusted properly with respect to the left basic line and the right basic line during zigzag stitching, and that the slack amount of the lower thread is adjusted properly with respect to the left basic line and the right basic line during forming stitches. Another object of the present invention, is to provide a cam portion to the lower thread contact of a needle plate for guiding the lower thread when changing the passage of the lower thread, so that the slack amount of the lower thread may be adjusted properly with respect to the left basic line and the right basic line during stitch formation, and that the lower thread of the zigzag stitch is made properly on the reverse side of the sewn fabric.

DETAILED DESCRIPTION OF THE PREFERRED EMBODIMENT

The invention will be explained with reference to an embodiment shown on the attached drawings.

Figure 1:
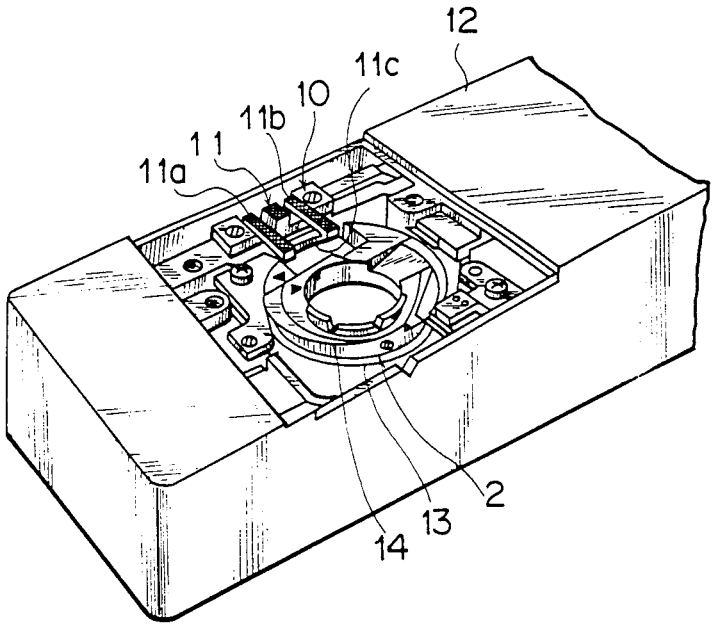
FIG. 1 is a perspective view showing the interrelation between the horizontal rotary loop taker and the feed dog, with the needle plate removed.
Figure 2:
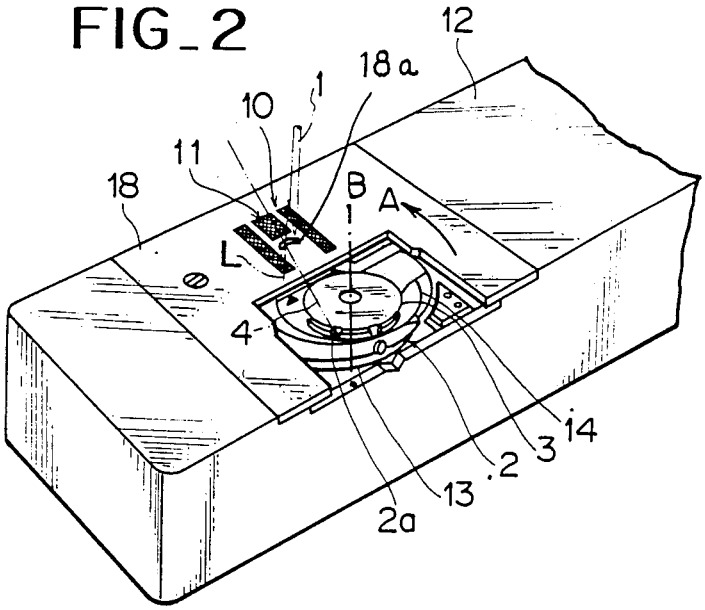
FIG. 2 is a perspective view showing the needle plate mounted on the device of FIG. 1.
Figure 5:
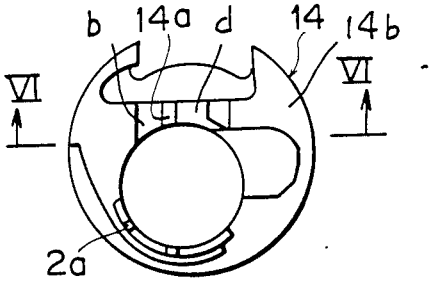
FIG. 5 is a plan view of a bobbin carrier.
Figure 6:
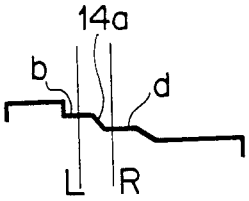
FIG. 6 is a front view showing a cam portion for supplying the lower thread as seen from VI—VI in FIG. 5.
Figure 10:
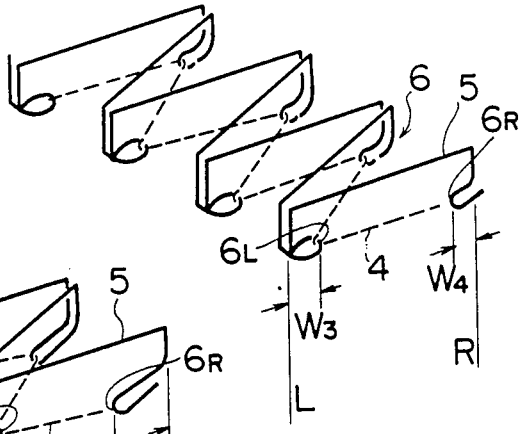
FIG. 10 is a perspective view showing properly produced zigzag stitches.
Figure 4:
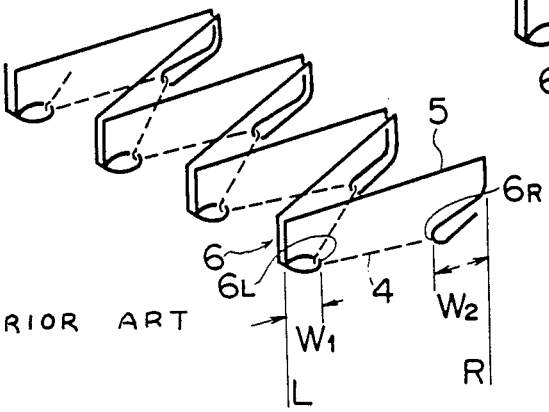
FIG. 4 is a perspective view showing poorly produced zigzag stitches.
Figure 7:
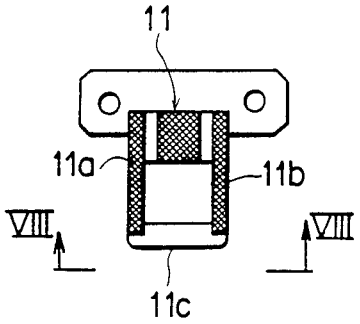
FIG. 7 is a plan view of a feed dog.
Figure 8:
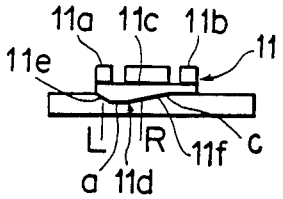
FIG. 8 is a front view as seen from VIII—VIII in FIG. 7.

A device (10) for adjusting the amount of slack in the lower thread according to the present invention, comprises a horizontal rotary loop taker device 2 and a feed dog 11. The device 2 comprises a loop taker 13 and a bobbin carrier 14 for a bobbin 3, the former making a full rotation in the direction of arrow A around a vertical axis B, pivoted in front of a needle 1 to a machine frame 12, and the latter being housed in the former and restrained against rotation and movement in the axial direction. On a lower thread contact, a cam portion 14*a* is provided which supplies the lower thread and is defined as being obliquely stepwise from the left basic line L to the right basic line R, as shown in FIGS. 5 and 6. The feed dog 11 is disposed in the vicinity of the passage of the needle 1, such that it is set to move vertically and horizontally. A cam portion 11d for supplying the lower thread, as shown in FIG. 8, is disposed under a portion 11*c* which connects left and right teeth 11*a*, 11*b* of the feed dog 11. The portion 11*c* is the lower thread contacting portion. The portion 11*c* extends substantially in parallel with the laterally elongated needle dropping hole 18*a*. The feed dog 11 is further defined with a cam portion 11*e* formed obliquely upward in the left basic line L, and with a cam portion 11*f* formed obliquely upward from the cam portion 11*e* in the right basic line R. In FIG. 2, a reference numeral 18 designates a needle plate mounted on a machine frame 12.

The device of the present invention is constructed as mentioned above. Further reference will now be made to its operation. The lower thread 4 is pulled out from the bobbin 3 due to the cooperation of vertical movement of the feed dog 11 and the bobbin carrier 14.

Figure 9:
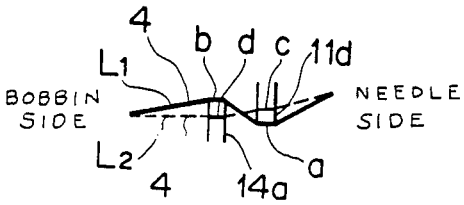
FIG. 9 is a schematic view showing the relationship of the cam portions for supplying the lower threads in the feed dog and the bobbin carrier.

In the left basic line L, the lower thread 4 contacts the lowermost point (a) of the cam portion 11*d* of the feed dog 11 and the uppermost point (b) of the cam portion 14*a* of the bobbin carrier 14, as is shown as a solid curve line ($L_1$) in FIG. 9.

In the right basic line R, the lower thread 4 contacts the uppermost point (c) of the cam portion 11*d* of the feed dog 11 and the lower most point (d) of the cam portion 14*a* of the bobbin carrier 14, as is shown as a broken curve line ($L_2$) in FIG. 9.

Thus, the passage of the lower thread in the left basic line L is longer than the passage of the lower thread in the right basic line R.

In the present case, the amount of the lower thread supplied for forming the stitches in the left basic line L corresponds to the length of the curve line ($L_2$). On the other hand, the amount of the lower thread supplied for forming the stitches in the right basic line R corresponds to the length of the curve line ($L_1$), which is larger than in the left basic line L. Accordingly, the amount of slack in the lower thread in the right basic line R when forming the stitches is larger than the amount of slack in the lower thread in the left basic line L.

In other words, the cam operates so that a predetermined amount of the lower thread 4 is drawn from the bobbin carrier 14 with a proper tension applied thereto when the lower thread is interlocked with the upper thread 5 at the left end needle position, and the tension of the lower thread 4 is reduced when the lower thread 4 is interlocked with the upper thread 5 at the right end needle position.

When the zigzag stitching is carried out at the largest amplitude, the zigzag stitches seen on the reverse side of the sewn fabric are furnished off pretty because the width ($W_3$) between the left knotting ($6_L$) and the left basic line (L) is almost equal with the width ($W_4$) between the right knotting ($6_R$) and the right basic line (R).

When the straight stitch is carried out on the left basic line L, by means of the cam face 11e of the cam portion 11*d* in the feed dog 11, the hitch stitch is no longer made since the lower thread 4 does not move to the right.

In the present embodiment, the lower thread is adjusted in the amount supplied by the cooperation of the bobbin carrier 14 and the feed dog 11, but it may be done similarly by individuals.

Figure 3:
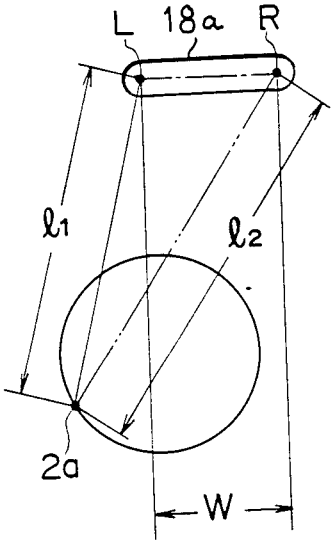
FIG. 3 is an explanatory view showing the relationship of the slack amount between the left basic line and the right basic line.
Figure 11:
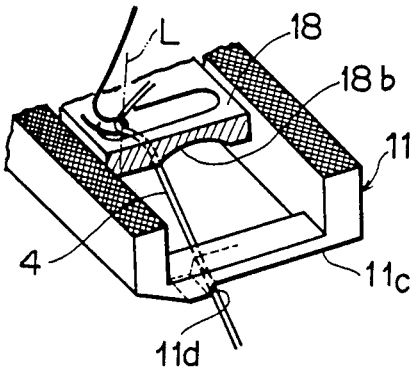
FIG. 11 is a perspective view showing the cooperation between the needle plate and the feed dog.

As shown in FIG. 11, the needle plate 18 is formed with a cam portion 18*b* for guiding the lower thread at the lower thread contact. If the lower thread 4 at the left basic line L is bent as shown, the length ($l_1$) of the lower thread 4 in FIG. 3 is made approximately as large as the length ($l_2$) of the lower thread 4, thereby making the upper and lower threads correspond in the slack amounts produced when forming the stitches in the left basic line L and the right basic line R. The operation therefor is almost the same as in the cam portions 14*a*, 11*d* of the bobbin carrier 14 or the feed dog 11.

In addition, the needle plate 18 may be, as shown in FIG. 11, incorporated with the feed dog 11 which has a cam portion 11d on the portion 11*c*. Otherwise, the needle plate 18, the bobbin carrier 14 and the feed dog 11 are properly combined for adjusting the amount of slack of the lower thread when forming the zigzag stitches.

What is claimed is:

1. An improved zigzag sewing machine which is provided with a needle plate having a laterally elongated needle dropping hole formed therein into which a needle with an upper thread vertically reciprocates as it laterally swings traversing the maximum range between a right end needle position and a left end needle position of the needle dropping hole 18*a*, a horizontal rotary loop taker having a central rotation axis located forwardly of the needle and rotated to catch an upper thread loop formed at the needle, a bobbin carrier having an upper face 14*b* and disposed horizontally in the loop taker and restrained against rotation, a bobbin loaded with the lower thread and disposed in said bobbin carrier, said lower thread being supplied to said needle dropping hole by way of a guide located leftwardly of the left end needle position, and a feed dog structure including a yoke extending substantially in parallel with the laterally elongated needle dropping hole and located forwardly of the needle dropping hole, the feed dog structure being operated to move vertically and horizontally to transport a sewn fabric relative to the needle while the yoke 11*c* engages the bobbin thread to draw out the same from the bobbin as the feed dog structure is vertically moved down, wherein the improvement comprises first slack control cam means 11*d* provided on said yoke 11*c* and second slack control cam means 14*a* provided on said upper face 14*b* of said bobbin carrier 14 and located forwardly of said first slack control cam means, said first slack control cam means including a first slack control cam extending substantially in parallel with said needle dropping hole 18*a*, said first slack control cam including a portion (a) most projecting down at a position opposite to said left end needle position L of said needle dropping hole and a portion (c) progressively reducing upward toward said right end needle position R of said needle dropping hole, said second slack control cam means including a second slack control cam extending substantially in parallel with said first slack control cam, said second slack control cam including a portion (b) most projecting up at a position opposite to said left needle position L of said needle dropping hole and a portion (d) progressively reducing down toward said right end needle position R of said needle dropping hole, said first and second slack cams 11*d*, 14*a* cooperating with each other to control the slack of said bobbin thread 4 with respect to the left and right end needle positions of said needle dropping hole during the zigzag stitching operation of the sewing machine.

2. An improved zigzag sewing machine as defined in claim 1, wherein the improvement further comprises said downwardly most projecting portion (a) of said first slack control cam and said upwardly most projecting portion (b) of said second slack control cam cooperate with each other to draw out a predetermined amount of said bobbin thread from said bobbin and maintain the drawn out bobbin thread in a tensioned condition when the needle drops at said left end needle position L of said needle dropping hole, and said upwardly progressively reducing portion (c) of said first slack control cam and said downwardly progressively reducing portion (d) of said second slack control cam cooperate with each other to allow said drawn out bobbin thread to slacken when the needle drops at said right end needle position R of said needle dropping hole.

* * * * *